US009735489B1

(12) United States Patent
Fan

(10) Patent No.: US 9,735,489 B1
(45) Date of Patent: Aug. 15, 2017

(54) LARGE CURRENT TRANSMISSION CONNECTOR

(71) Applicant: Amphenol Commercial Products (ChengDu) Co. LTD, Chengdu (CN)

(72) Inventor: Jun Fan, Suining (CN)

(73) Assignee: Amphenol Commercial Products (ChengDu) Co. LTD, Chengdu (CN)

( * ) Notice: Subject to any disclaimer, the term of this patent is extended or adjusted under 35 U.S.C. 154(b) by 0 days.

(21) Appl. No.: 15/232,768

(22) Filed: Aug. 9, 2016

(30) Foreign Application Priority Data

Apr. 6, 2016 (CN) ..... 2016 2 0277665

(51) Int. Cl.
*H01R 12/00* (2006.01)
*H01R 12/73* (2011.01)
*H01R 12/70* (2011.01)

(52) U.S. Cl.
CPC ..... *H01R 12/737* (2013.01); *H01R 12/7064* (2013.01)

(58) Field of Classification Search
CPC ..... H01R 12/737; H01R 12/7064
USPC ..... 439/62, 377, 839, 843
See application file for complete search history.

(56) References Cited

U.S. PATENT DOCUMENTS

| | | | | |
|---|---|---|---|---|
| 7,959,472 | B1 * | 6/2011 | Huang | H01R 13/20 439/668 |
| 8,616,904 | B1 * | 12/2013 | Martin | H01R 13/20 439/188 |
| 9,184,525 | B1 * | 11/2015 | Ranta | H01R 13/20 |
| 9,450,365 | B1 * | 9/2016 | Baldwin | H01R 35/04 |
| 9,627,825 | B2 * | 4/2017 | Leng | H01R 24/60 |

* cited by examiner

*Primary Examiner* — Khiem Nguyen
(74) *Attorney, Agent, or Firm* — Gokalp Bayramoglu

(57) ABSTRACT

The application discloses a large current transmission connector including the pallet assembly and the socket assembly. The pallet assembly includes the pallet and the guide pillar. The socket assembly includes a socket. The socket includes mounting holes and pins. The locking structure is arranged in the mounting hole. The locking structure is used for fixing the guide pillar on the socket and for conveying a current between the pallet assembly and the socket assembly. When the guide pillar and the locking structure are fixed together, the two guide pillars not only play the role of guiding, but also can carry the large current of 50 A. Thus, this connector does not need to set aside a lot of space for mounting the power supply pins. The space of the connector is saved effectively. The miniaturization trend of the connector is met.

8 Claims, 5 Drawing Sheets

LARGE CURRENT TRANSMISSION CONNECTOR

TECHNICAL FIELD

This application relates to connector, more particularly, relates to a large current transmission connector.

BACKGROUND

For the general specification of Card Edge Connector production, when the large current (50 A) is required, at least 2-3 pairs of the power supply pins which could carry 10 A to 30 A current, are indispensable, and the quantity is more than 2 pairs usually. It is desired to set aside not only the space for mounting the power supply pins, but also plenty space for assembling the communication pins. As a result, the existing connector is large in volume. However, in view of the miniaturization trend of the electronic devices, the Card Edge Connector product available in the market cannot meet the requirement of the miniaturization requirement.

SUMMARY

Regarding the defects of the prior art, this application provides a large current transmission connector which transmits the current through the locking structure.

In order to achieve the above purpose, the technical solution used by this application is:

A large current transmission connector is provided. It includes a pallet assembly and a socket assembly assembled together. The pallet assembly includes the pallet and the guide pillar which connects to the pallet. The socket assembly includes a socket. The socket includes a mounting hole which is arranged at both of it sends, and pins that are arranged in a line between the two mounting holes and are used for electrically connecting to the pallet to transmit the signal. The locking structure is arranged in the mounting hole. The locking structure is used for fixing the guide pillar on the socket and for conveying a current between the pallet assembly and the socket assembly.

The advantageous effects of this application are as follows. When transmitting the signal and the current, the guide pillar forms the male end of the connector, and the locking structure forms the female end of the connector. The guide pillar and the locking structure are fixed together to form the matching structure of the male and female ends, the two guide pillars not only play the role of guiding, but also can carry the large current of 50 A. Thus, this connector does not need to set aside a lot of space for mounting the power supply pins. The space of the connector is saved effectively. The miniaturization trend of the connector is met.

Wherein, 1. pallet assembly; 2. screw; 3. guide pillar; 31. screw hole; 32. concave relief groove; 33. locking portion; 34. mounting portion; 35. positioning portion; 4. socket; 41. mounting hole; 5. crowned spring; 6. guide sleeve; 61. connecting pillar, 62. mounting slot; 63. projecting portion; 7. PCB plate.

DETAILED DESCRIPTION

Embodiments of this application are described as follows, such that persons of ordinary skill in the art can understand the application. However, it is clear that the scope of this application is not limited to the specific embodiment. For persons of ordinary skill in the art, long as the variations fall within the spirit and scope of this application as defined and determined by the appended claims, and if the modification is obvious, all of the inventive concepts based on this application are in the protection scope.

Figure 1:
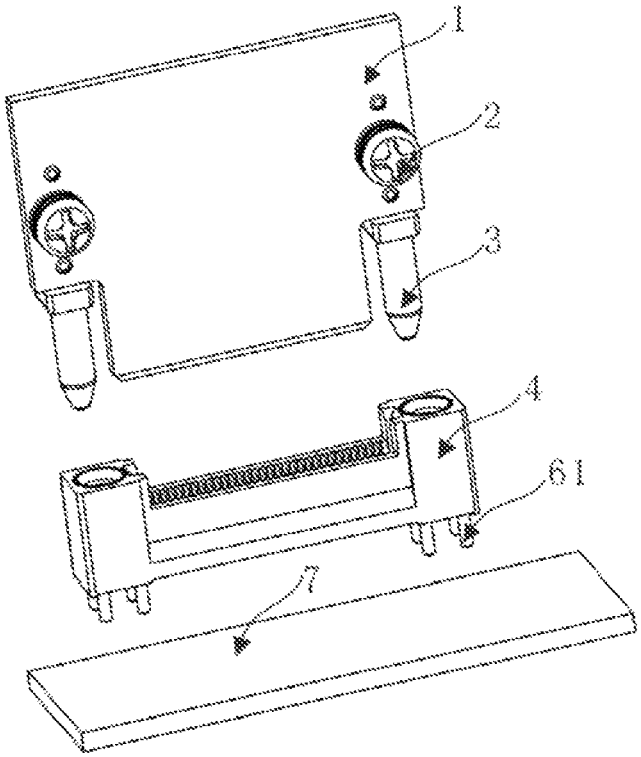
FIG. 1 is the schematic diagram of one embodiment of the assembly process for the pallet assembly, socket assembly and PCB plate assembly.
Figure 2:
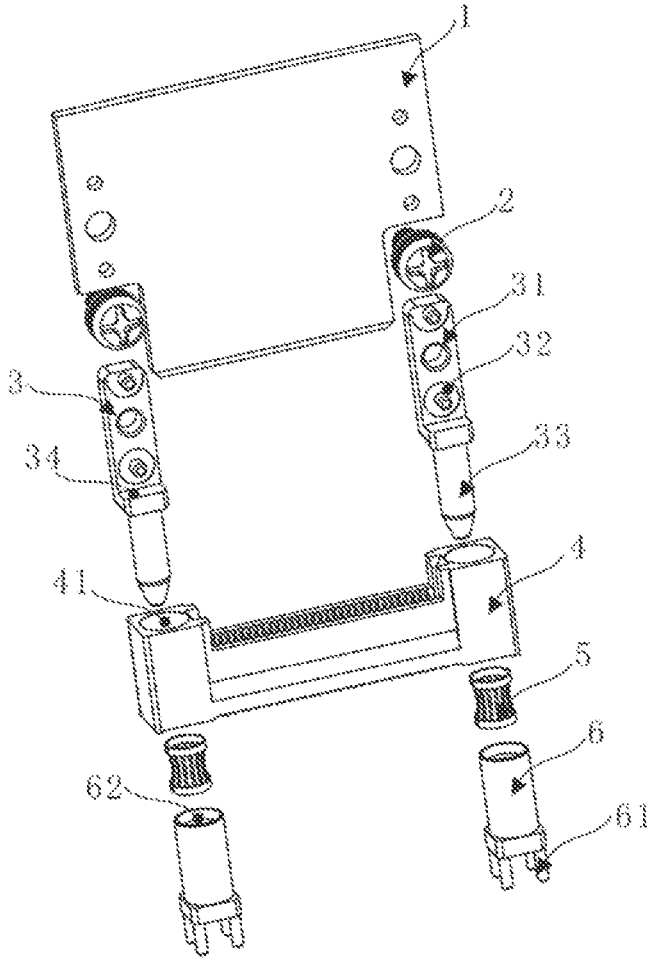
FIG. 2 is an explosive view of the large current transmission connector.

Referring to FIGS. 1 and 2, FIG. 1 shows the schematic diagram of one embodiment of the assembly process for pallet assembly 1, socket assembly 2, and PCB plate 7; and FIG. 2 shows the explosive view of the large current transmission connector. As shown in FIGS. 1 and 2, the large current transmission connector includes pallet assembly 1 assembled together with socket assembly.

Pallet assembly 1 includes pallet (the pallet mentioned here and throughout the full text actually is a PCB plate) and guide pillar 3 which electrically connects to the pallet. When implementing, the guide pillar may include mounting portion 34 for mounting the pallet and locking portion 33 which connects to mounting portion 34 and is used for mounting pallet assembly 1 to the socket assembly.

In order to ensure that the pallet is firmly fixed on mounting portion 34, at least one screw hole 31 and at least one aligning hole are arranged on the pallet. At least one positioning portion 35 may be arranged on mounting portion 34. In order to achieve accurate positioning, in operation, two positioning portions 35 are arranged on the section where the pallet and mounting portion 34 contacts with each other. They are arranged on both sides of the contacting section.

After the pallet is positioned by the aligning holes and positioning portion 35, at least one screw 2 is used to fixedly mount the pallet onto mounting portion 34. When the pallet is mounted on positioning portion 35, screw 2 may be selected according to the specific length of the contacting section of the pallet and mounting portion 34, as long as the ultimate purpose of firmly fixing the pallet on mounting portion 34 can be achieved. The solution preferably uses screw 2 for fixation. However, when fixing the pallet, it is not limited to the fixing manner of screw 2. Other structures, such as bolts, studs, pins, keys, and etc. maybe used as long as they can fix the pallet and mounting portion 34 together in a connecting manner which is detachable.

Figure 3:
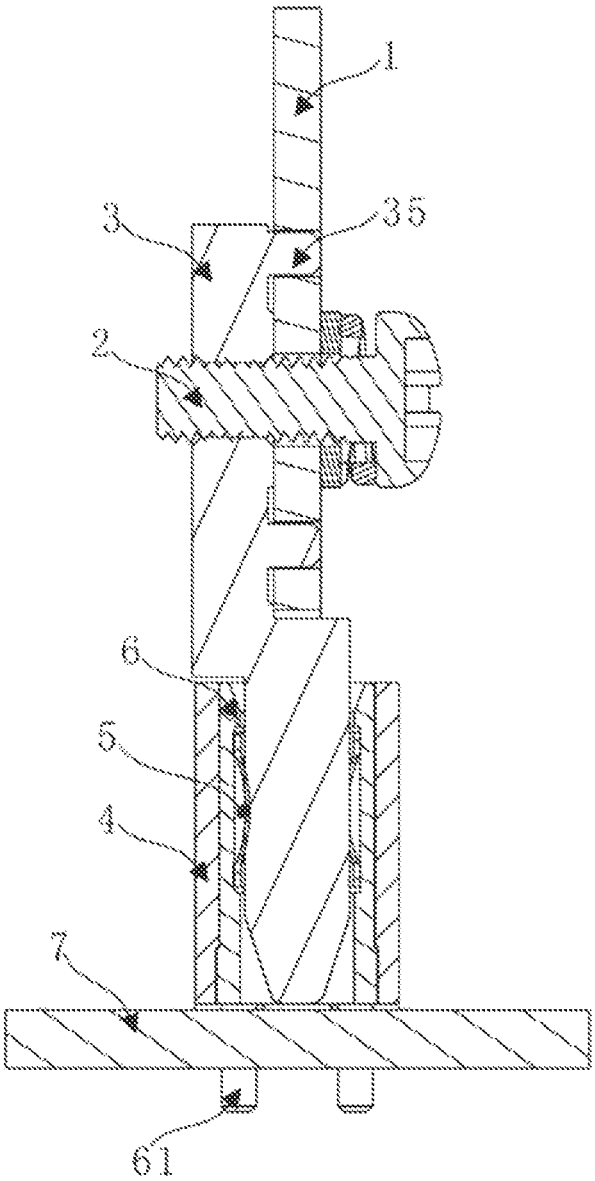
FIG. 3 is the section view of one embodiment of the large current transmission connector.

As shown in FIG. 3, mounting portion 34 of the solution preferably is arranged in an L-shape. Positioning portion 35 and screw 2 are arranged on the long side of the L-shape of mounting portion 34. Locking portion 33 is arranged on the short side of the L-shape of mounting portion 34. When implementing, the length of the short side of the L-shape of mounting portion 34 maybe arranged larger than the thickness of the pallet, after the pallets are set in mounting portion 34 not only can fix the pallets, but also can protect the contacting section of the pallet and mounting portion 34, so as to avoid external shocks along the thickness direction of the contacting section of the pallet and mounting portion 34.

At the position of positioning portion 35, there is a concave relief groove 32 which is used to make the pallet and the long side of the L-shape of mounting portion 34 close fits with each other. Such arrangement may reduce the positioning error between the pallet and mounting portion 34. Moreover, positioning portion 35 actually is a round positioning pin. Its thickness approximately equals to the thickness of the pallet. Using the positioning pin to connect the pallet can fix the pallet in the X and the Y directions of the. After screw 2 connects to the pallet, it is mainly achieved that the pallet is fixed in the Z direction.

As shown in FIGS. 1-3, the socket assembly includes socket 4, mounting holes 41 positioned on both ends of socket 4, and the pins that are arranged in lines between two mounting holes 41 and are used to electrically connect to the pallet to transmit the signal. The pins are generally arranged in two rows. The pallet is mounted between the two rows of pins. The locking structure arranged in mounting hole 41 is used to fix guide pillar 3 on socket 4 and to convey the current between the pallet assembly and the socket assembly.

When conveying the signal and the current, guide pillar 3 forms the male end of the connector, and the locking structure forms the female end of the connector. When guide pillar 3 and the locking structure are fixed together to form the matching structure with the male and female ends, the two guide pillars 3 not only play the role of guiding, but also can carry the large current of 50 A.

In one embodiment of this application, the locking structure may include guide sleeve 6. Guide sleeve 6 includes the guide portion which is mounted within mounting hole 41 and has mounting slot 62; and the connecting portion which is positioned outside mounting hole 41 and is used to electrically connect to PCB plate 7. Crowned spring 5 which is used to fasten guide pillar 3 is arranged in mounting slot 62 of guide sleeve 6.

When using the existing card edge plug-in connector, the reliability of connection is low, and the ability to resist the external shock is poor. This solution introduces crown spring 5 into the locking structure, fastening guide pillar 3 inserted in mounting guide sleeve 6. Therefore, the connector of this solution has the advantages of small contact resistance, easy plugging, anti-vibration, impact resistance, hot plugging, and etc.

When using, in order to ensure guide pillar 3 is limited stably in mounting slot 62 of guide sleeve 6, the specific structure and size of the guide portion which has mounting slot 62 may be optimized to some extent. Also, the specific structure and size of the connecting portion may be optimized.

When optimizing connecting portion, as shown in FIGS. 2 and 3, the connecting portion may be arranged to have the step section whose size is larger than that of mounting hole 41, and a plurality of connecting pillars 61 that are arranged on the step sections and are used to electrically connect to PCB plate 7.

Figure 4:
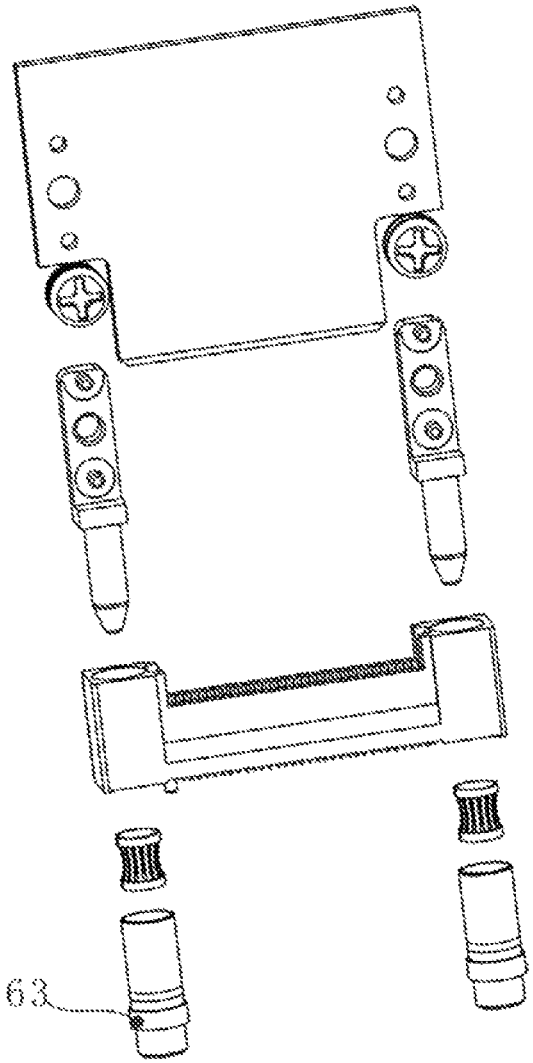
FIG. 4 is the schematic diagram of another embodiment of the assembly process for the pallet assembly, the socket assembly, and the PCB plate assembly.
Figure 5:
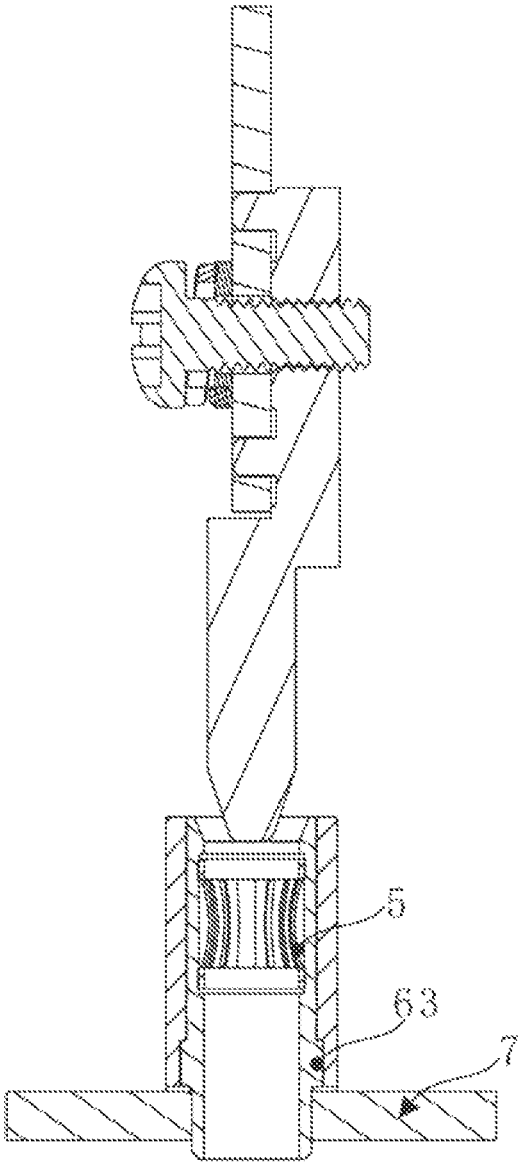
FIG. 5 is the section view of another embodiment of the large current transmission connector.

When optimizing the guide portion, as shown in FIGS. 4 and 5, projecting portion 63 can be arranged on the guide portion so as to lock the guide sleeve in the mounting hole. Also, the groove which matches projecting portion 63 is arranged in mounting hole 41. Projecting portion 63 is arranged in the slot inside mounting hole 41. When using, projecting portion 63 may also be arranged as an annular convex structure. Under such circumstances, the structure of the slot also needs to be adjusted accordingly.

When projecting portion 63 is arranged on the guide portion, there are not too many requirements for the specific structure of the connecting part, as long as the electrical connection to the PCB plate can be achieved.

Although the embodiments of the application are described in detail in combination with the drawings, it should not be construed as restrictions of the scope of this patent. Within the scope of the claims, any alternations and variations made by persons with ordinary skill in the art without creative labor also fall into the scope of this patent.

What is claimed is:

1. A large current transmission connector, comprising:

a pallet assembly and a socket assembly that are assembled together;

wherein:

the pallet assembly includes a pallet and a guide pillar which connects to the pallet; and the socket assembly includes a socket, the socket having mounting holes arranged at both ends of the socket, and pins that are arranged in lines between two mounting holes and are used to electrically connect to the pallet to transmit a signal, wherein a locking structure is arranged in the mounting hole, the locking structure being used for fixing the guide pillar on the socket and for conveying a current between the pallet assembly and the socket assembly.

2. The large current transmission connector according to claim 1, wherein:

the locking structure comprises:

a guide sleeve, including a guide portion mounted within the mounting hole and having a mounting slot, and a connecting portion, positioned outside the mounting hole and being used to electrically connect to a PCB plate;

wherein a crown spring being used for connecting the guide pillar is arranged in the mounting slot of the guide sleeve.

3. The large current transmission connector according to claim 2, wherein:

the connecting portion comprising:

a step section, having a size larger than that of the mounting hole, and several connecting pillars, arranged on the step section, and being used to connect to the PCB plate.

4. The large current transmission connector according to claim 2, wherein a projecting portion being used for locking the guide sleeve in the mounting hole is arranged on the guide portion, and wherein the projecting portion is arranged inside the slot.

5. The large current transmission connector according to claim 1, wherein:

the guide pillar comprising:

a mounting portion, being used for mounting the pallet, and a locking portion, connecting to the mounting portion to combine thereof, and being used for mounting the pallet assembly on the socket assembly.

6. The large current transmission connector according to claim 5,

Wherein at least one positioning portion is arranged on the mounting portion; and wherein once the pallet is positioned by the positioning portion, the pallet is fixedly mounted on the mounting portion with at least one screw.

7. The large current transmission connector according to claim 6, wherein the mounting portion is arranged in an L-shape, and wherein the positioning portion and the screw are arranged on the long side of the L-shape of the mounting portion, and the locking portion is arranged on the short side of the L-shape of the mounting portion.

8. The large current transmission connector according to claim 7, wherein a concave relief groove being used for making the pallet and the L-shape of the mounting portion close fit with each other is arranged at the position of the positioning portion.

* * * * *